US006762723B2

(12) United States Patent
Nallo et al.

(10) Patent No.: US 6,762,723 B2
(45) Date of Patent: Jul. 13, 2004

(54) WIRELESS COMMUNICATION DEVICE HAVING MULTIBAND ANTENNA

(75) Inventors: Carlo Di Nallo, Sunrise, FL (US); Antonio Faraone, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/291,305

(22) Filed: Nov. 8, 2002

(65) Prior Publication Data

US 2004/0090372 A1 May 13, 2004

(51) Int. Cl.[7] ..... H01Q 1/38

(52) U.S. Cl. ..... 343/700 MS; 343/702; 343/767

(58) Field of Search ..... 343/700 MS, 702, 343/767, 872; 455/89, 90

(56) References Cited

U.S. PATENT DOCUMENTS 6,133,880 A * 10/2000 Grangeat et al. .... 343/700 MS
6,366,243 B1 * 4/2002 Isohatala et al. ..... 343/700 MS
6,501,425 B1 * 12/2002 Nagumo et al. ..... 343/700 MS
6,542,050 B1 * 4/2003 Arai et al. ..... 333/134
6,646,610 B2 * 11/2003 Troelsen ..... 343/702
6,650,295 B2 * 11/2003 Ollikainen et al. .. 343/700 MS

OTHER PUBLICATIONS

King, R.W.P., PhD., Harrison, C.W., Jr., Ph.D. "Antennas and Waves: A Modern Approach," 1969, The M.I.T. Press, Cambridge, Massachusetts and London, England.

* cited by examiner

*Primary Examiner*—Tan Ho
(74) *Attorney, Agent, or Firm*—Randi L. Karpinia

(57) ABSTRACT

The invention provides antenna systems (102, 900, 2300, 2800) for wireless communication devices that make efficient use of space while supporting multi-band operation. The antenna systems comprise elongated flat conductors (206,406,902,1206,1508,1304,1902,2000,2100,2302,2500, 2600,2702,2802,2902), supported spaced from finite ground planes (202, 914, 1910). The antenna systems are capable of operating in a symmetric common mode, an anti-symmetric differential mode, and a slot mode.

20 Claims, 11 Drawing Sheets

2200

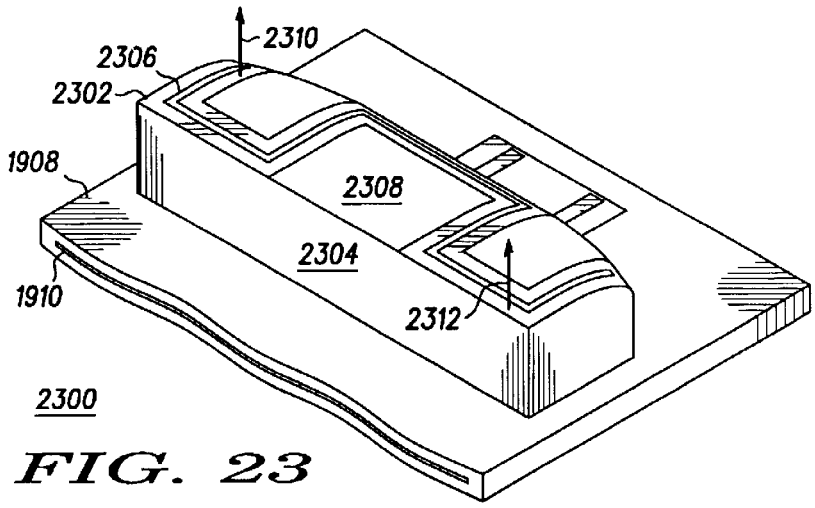
FIG. 23
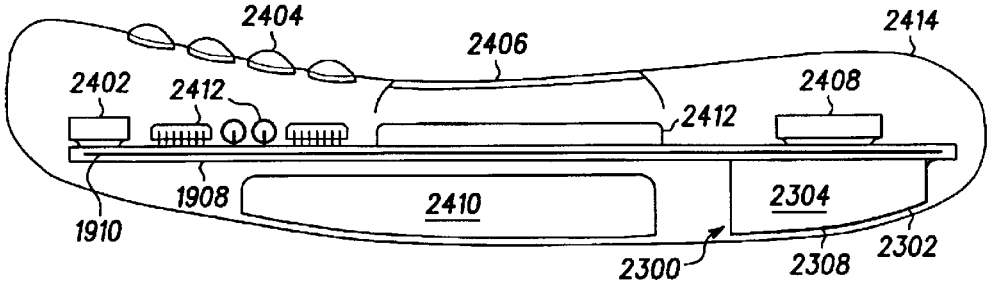
2400 FIG. 24
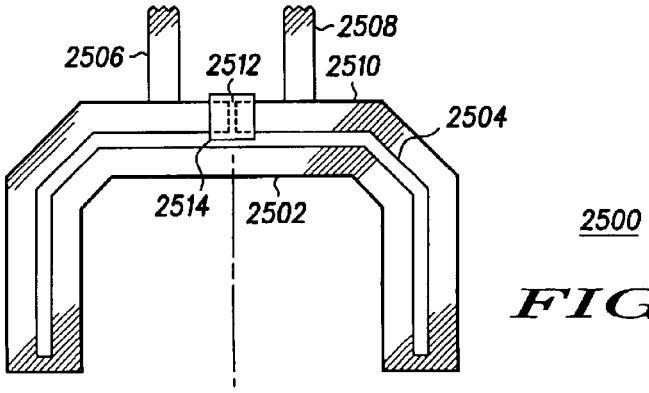
FIG. 25

WIRELESS COMMUNICATION DEVICE HAVING MULTIBAND ANTENNA

BACKGROUND OF THE INVENTION

1. Field of the Invention

The present invention relates in general to antennas. More particularly, the present invention relates to multi-band antennas.

2. Description of Related Art

Currently in the wireless communication industry there are a number of competing communication protocols that utilize different frequency bands. In a particular geographical region there may be more than one communication protocol in use for a given type of communication e.g., wireless telephones. Examples of communication protocols for wireless telephones include GSM 900, AMPS, GSM 1800, GSM 1900, and UMTS. In addition, certain communication protocols may be exclusive to certain regions. Additionally future communication protocols are expected to utilize different frequency bands. It may be desirable to provide 'future proof' communication devices that are capable of utilizing a currently used communication protocol, as well as communication protocols that are expected to be utilized in the near future.

It is also desirable to be able to produce wireless communication devices capable of operating according to more than one communication protocol. The latter may necessitate receiving and transmitting signals in different frequency bands. It is desirable to have smaller antennas for wireless communication devices that are capable of operating in multiple frequency bands, rather than having separate antennas for different bands.

Wireless communication devices have shrunk to the point that monopole antennas sized to operate at the operating frequency of the communication device are significant in determining the overall size of the communication devices in which they are used. In the interest of user convenience in carrying portable wireless communication devices, it is desirable to reduce the size of the antenna and it is desirable to have an antenna that can be fit within in a device housing in a space efficient manner.

BRIEF DESCRIPTION OF THE FIGURES

The present invention will be described by way of exemplary embodiments, but not limitations, illustrated in the accompanying drawings in which like references denote similar elements, and in which:

FIG. 23 is an antenna system according to an eleventh embodiment of the invention;

FIG. 24 is a sectional side view of a wireless communication device 2400 including the antenna system 2300 shown in FIG. 23;

FIG. 25 is plan view of an elongated flat conductor for the antenna system shown in FIGS. 2–3 according to a twelfth embodiment of the invention;

DETAILED DESCRIPTION OF THE PREFERRED EMBODIMENTS

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

Figure 1:
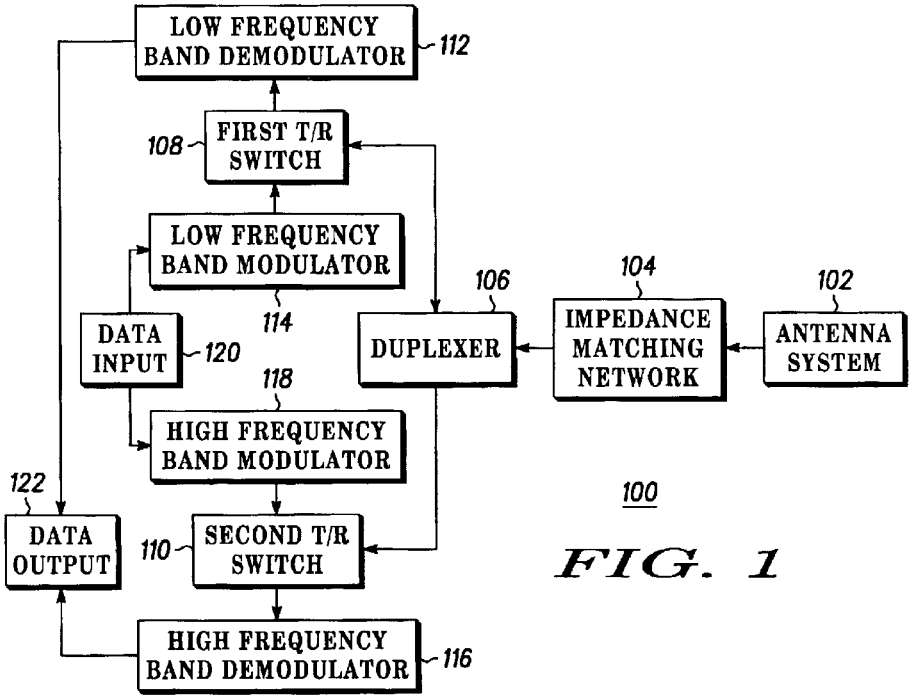
FIG. 1 is a functional block diagram of a wireless communication device according to a first embodiment of the invention.
Figure 17:
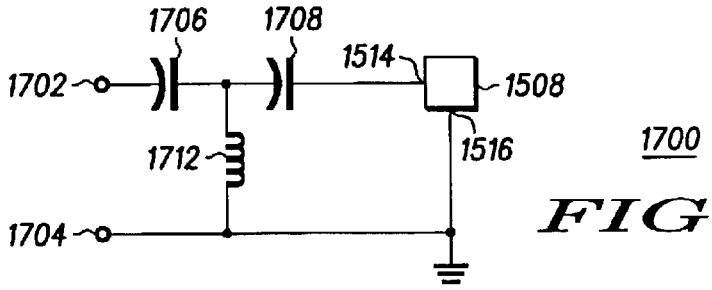
FIG. 17 is an impedance matching circuit for use in the wireless communication device shown in FIG. 15 according to a seventh embodiment of the invention.

FIG. 1 is a functional block diagram of communication circuits 100 and an antenna system 102 of a wireless communication device according to a first embodiment of the invention. The antenna system 102 is coupled to an impedance matching network 104. A particular implementation of the impedance matching network 104 is shown in FIG. 17. The impedance matching network 104 is coupled to a duplexer 106. The duplexer 106 selectively couples signals in a first lower frequency range to and from a low frequency transmit-receive T/R switch 108, and selectively couples signals in a second higher frequency range to and from a high frequency T/R switch 110. The low frequency T/R switch 108 is coupled to a low frequency demodulator 112, and to a low frequency modulator 114. Similarly the high frequency T/R switch 110 is coupled to a high frequency demodulator 116, and a high frequency modulator 118. A data input 120 is coupled to the low and high frequency band modulators 114, 118. The data input 120 can for example comprise a microphone and a digital voice encoder. A data output 122 is coupled to the low and high frequency demodulators 112, 116. The data output 122 can for example comprise a voice decoder and a loudspeaker. The communication circuits 100 are adapted to process signal in at least two frequency bands, and are preferably adapted to handle frequencies in at least three frequency bands. The modulators 114, 118 and demodulators 112, 116 can for example be configured for phase, frequency, and/or amplitude modulation. Depending of the type of signaling used, the T/R switches may or may not be required.

Alternatively rather than using separate low and high frequency band components, a communication circuit that includes a single wide band demodulator, and a single wide band modulator is used. As a further alternative, a communication circuit that includes three or more demodulators, and/or modulators to handle three or more frequency bands is used. According to yet another alternative embodiment rather than using a plurality of separate transmitters and receivers, a communication circuit that includes software configurable transmitters and receivers that can be configured to support a plurality of protocols in a plurality of frequency bands is used.

Figure 2:
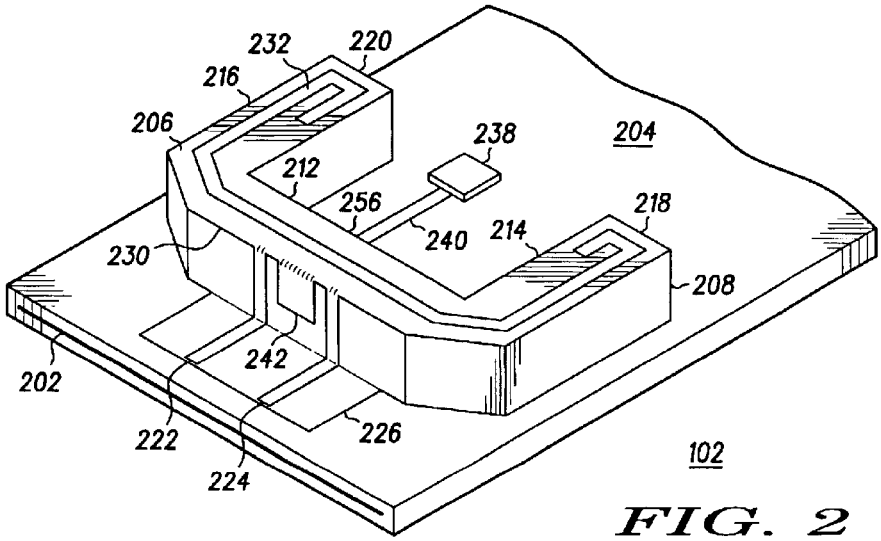
FIG. 2 is first perspective view of an antenna system for use in conjunction with the communication circuits shown in FIG. 1 according to the first embodiment of the invention.
Figure 3:
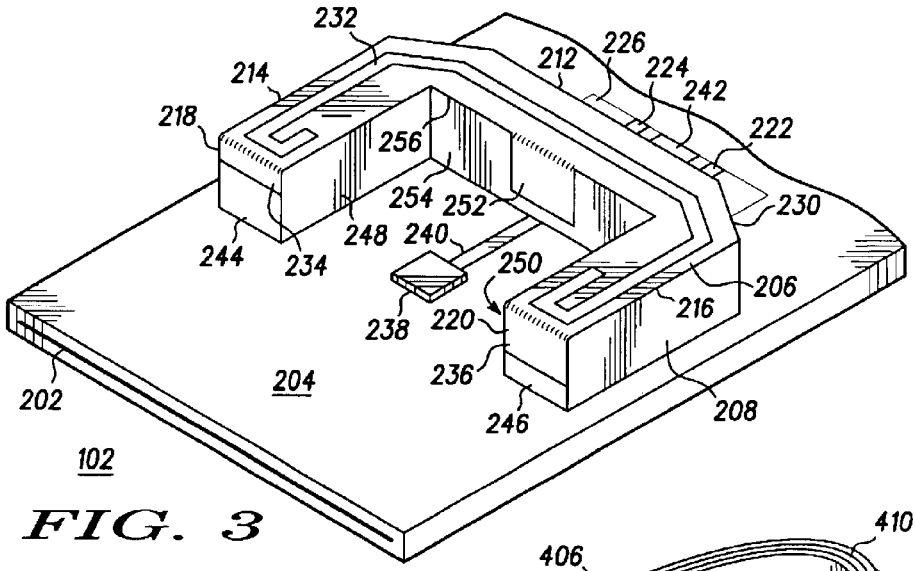
FIG. 3 is a second perspective view of the antenna system shown in FIG. 2.

FIG. 2 is first perspective view of the antenna system 102 used in conjunction with the communication circuits 100 shown in FIG. 1 according to the first embodiment of the invention and FIG. 3 is a second perspective view of the antenna system 102. A finite ground plane 202 of the antenna system 102 is included as one layer, in a multi-layer circuit board 204. Alternatively, rather than using a ground plane a ground surface that is not planar is used. Alternatively, the finite ground plane 202 includes several connected layers of the multi-layer board 204. The multi-layer circuit board 204 is preferably used to support and interconnect other electrical components (only one of which is shown in FIGS. 2–3) of the wireless communication device 100. In lieu of a multi-layer circuit board, a flexible single or multi-layer circuit substrate is used.

A generally U-shaped elongated flat conductor 206 is spaced from the circuit board 204, and the finite ground plane 202, by a congruently U-shaped dielectric spacer 208. The U-shape of the elongated flat conductor 206 includes a base segment 212, a first leg 214 extending from the base segment 212, and a second leg 216 extending from the base segment 212. The elongated flat conductor 206 includes a first end 218 at a free end of the first leg 214, and a second end 220 at a free end of the second leg 216. A signal feed conductor 222 connects the base segment 212 of the conductor 206 to the circuit board 204, and a grounding conductor 224 connects the base segment 212 of the conductor 206 to the finite ground plane 202. As shown, the signal feed conductor 222, and the grounding conductor 224 are supported on a portion of a flexible dielectric support 226, which may or may not be adhesively constrained on the dielectric spacer 208. Although, as shown the signal feed conductor 222 and the grounding conductor 224 are located symmetrically with respect to the elongated flat conductor 206, this need not be the case.

Although as shown, and as preferred, the signal feed conductor 222, and the grounding conductor 224 form conductive connection to the elongated flat conductor 206, alternatively a capacitive break is made in either or both the signal feed conductor 222, and the grounding conductor 224, and signals are capacitively coupled to the elongated flat conductor 206. As known in the art, a high capacitance coupling is nearly equivalent to a conductive coupling. Alternatively, a discrete capacitor component is connected across the capacitive break. Although, as shown the signal feed conductor 222, and the grounding capacitor 224 are of uniform width alternatively one or both are tapered.

A first capacitive tab 242 extends from the elongated flat conductor 206 between the signal feed conductor 222 and the grounding conductor 224, onto the flexible dielectric support 226, toward the finite ground plane 202. The first capacitive tab 242 serves to counterbalance the inductance between the signal feed conductor 222 and the grounding conductor 224, and thereby adjust the reactance of the input impedance of the antenna system 102. The flexible dielectric support 226 is preferably a low-loss material such as polyimide. The elongated flat conductor 206 is preferably also formed on the same flexible dielectric support 226. The elongated flat conductor 206, the signal feed conductor 222, and the grounding conductor 224, and the capacitive tab 242 are preferably integrally formed on the flexible dielectric support 226 by lithographic etching or printing. The signal feed conductor 222, and the grounding conductor 224 connect at right angles to an external edge 230 of the U-shaped elongated flat conductor 206, preferably within a middle ½ (lengthwise) portion of the conductor 206. The separation between the signal feed conductor 222 and the grounding conductor is adjusted for impedance matching purposes. The signal feed conductor 222 and the grounding conductor 224 are preferably separated by between 4 and 30 millimeters. The latter range is suitable in particular to present-day communication bands. Bringing the signal feed conductor 222 and the grounding conductor 224 too close together also tends to decrease the bandwidth of operating bands of the antenna system 102, while separating the signal feed conductor 222 and the grounding conductor 224 too far apart tends to increase the impedance of the antennas system 102.

According to an alternative embodiment of the invention the signal feed conductor 222, and the grounding conductor 224 are coupled to the elongated flat conductor 206 through a tab (similar to the first capacitive tab 204) that extends from the elongated flat conductor 206 toward the ground plane 202.

A slot 232 is formed in the elongated flat conductor 206. The slot 232 runs from near the first end 218 towards the first end 218, then turns through two right angle turns to double back, and runs toward the base segment 212, along the base segment 212, down the second leg 216, to the second end 220, through two more right angle turns to double back, and for a short distance toward the base segment 212. The slot 232 is closed at both ends. Folding the path of the slot 232 through successive turns allows a desired length slot 232, which length determines the frequency of a slot mode of the antenna system 102 to be accommodated within the length of the elongated flat conductor 206. Instead of folding the path of the slot 232 as shown in FIGS. 2–3, the path of the slot 232 can, for example, be made to meander. The slot 232 follows a path characterized by a length that exceeds the length of the elongated flat conductor 206. The slot 232 is preferably between one-quarter and one times a free space wavelength associated with a frequency of the slot mode, and is more preferably between one-half and three-quarters the free space wavelength associated with the slot mode, and is even more preferably about three-fifth the free space wavelength associated with the slot mode. The slot 232 is preferably less than 5 millimeters wide. Although the slot 232 and has a constant width, alternatively the width of the slot 232 is variable.

The length of the external edge 230 is selected to control the frequency of a common mode of the antenna system 102, and the length of an inner edge 256 of the elongated flat conductor 206 is selected to control the frequency of a differential mode of the antenna system 102. Thus by controlling the length and width of the elongated flat conductor 206 frequencies of the common and differential modes are tuned to desired operating bands that are to be supported by the antenna system 102. The external edge 230 length of the elongated flat conductor 206 is preferably in the range of one-eighth to one-half times the free space wavelength associated with the frequency of the common mode. More preferably, the external edge 230 length is between one-quarter, and one-half the free space wavelength associated with the common mode, and even more preferably the external edge 230 is equal to about one-third the free space wavelength associated with common mode. The inner edge 256 length of the elongated flat conductor is preferably in the range of one-eighth to one times the free space wavelength associated with the differential mode frequency, and more preferably is in the range of one-quarter to one-half the free space wavelength associated with the differential mode frequency.

The flat conductor 206 includes a second capacitive tab portion 234 that extends at the first end 218 over a first end 244 of the dielectric spacer 208 toward the finite ground plane 202, and a third capacitive tab portion 236 that extends at the second end 220 over a second end 246 of the dielectric spacer 208 toward the finite ground plane 202. The third tab portion 236 reaches closer to the finite ground plane 202, than the second tab portion 234. Consequently, there is a lower capacitance between the conductor 206 and the finite ground plane 202 at the first end 218 than at the second end 220. The latter difference leads to different halves of the antenna system 102 resonating at slightly different center frequencies in the common mode, and consequently widens a band of operation of the antenna system 102 that is attributable to the common mode. Widening of the band of operation is useful in providing adequate bandwidth to accommodate multiple communication protocols, for example Global System for Mobile Communications (GSM) communication in both the nominal 850 MHz and nominal 900 MHz bands. Alternatively the second capacitive tab 234 is placed on a first inside surface 248 (inside of U-shape) of the U-shaped dielectric spacer 208, adjacent the first end, and the third capacitive tab 236 is placed on a second inside surface 250 of the U shaped dielectric spacer 208 adjacent the second end 246. The second 234 and third 236 capacitive tabs are located at positions of high charge accumulation that occur when the antenna system 102 is operating in the differential mode and in the common mode. Therefore, the second 234 and third 236 capacitive tabs effectively increase the capacitance between the conductor 206 and the finite ground plane 202 and thereby lower the resonance frequencies of the common and differential modes. Thus, the second 234, and third 236 capacitive tabs can be dimensioned to effect tuning.

According to an alternative embodiment of the invention, the slot 232 extends onto the first, and/or the second capacitive tabs 234, 236.

A fourth capacitive tab 252 extends from the base segment 212 of the elongated flat conductor 206 down along a third inside surface 254 of the dielectric spacer 208 toward the finite ground plane 202. The fourth capacitive tab 252 is located across from the first capacitive tab 242. The fourth capacitive tab 252 is located at a point of high current for the differential mode, and low current for the common mode and for a slot mode. The primary effect of the fourth capacitive tab 252 is to lower the inductance seen for currents associated with a differential mode, and thereby to increase the resonance frequency of the differential mode.

Making the dielectric spacer 208 congruent (in plan view) to the outline of the elongated conductor 206 as opposed to congruent to the finite ground plane 202 is advantageous in that it allows for the provision of the capacitive tabs 234, 236, 242, 252. Alternatively only certain surfaces of the dielectric spacer 208, that can be used to located capacitive tabs extending toward the ground plane, are aligned with edges of the elongated conductor 206. Making the dielectric spacer 208 congruent to the outline of the elongated conductor, also frees space for placement of other electrical components of the wireless communication device 100.

The finite ground plane 202 of the antenna system 102, and of other antenna systems described below are preferably smaller in each dimension than the one-half the free space wavelength corresponding to the common mode of the antenna system 102. Limiting the size of the finite ground plane 202 is believed to prevent the finite ground plane 202 from perfectly mirroring the currents on the elongated flat conductor 206, and thereby improves the bandwidth and efficiency of the antenna system 102.

The flatness of the elongated flat conductor 206 enhances the interaction between the conductor 206 and the finite ground plane 202, and thereby facilitates operation of the differential and common modes. Limiting the spacing between the elongated flat conductor 206 and the finite ground plane 202 to less than one-tenth the free space wavelength associated with the frequency of the common mode also enhances interaction between the conductor 206 and the finite ground plane 202, and facilitates operation in the common and differential modes. In general, in the embodiment shown in FIGS. 2–3 and in other embodiments described herein below the elongated conductors used preferably extend over their respective finite ground planes (measured in a direction parallel to their respective ground planes) a distance of at least three-quarters times the maximum separation between the respective elongated conductor and their respective ground plane. Moreover, it is preferable that the projected length of the elongated conductor 206, projected perpendicularly (with respect to the finite ground plane 202) onto the finite ground plane 202 be equal to at least ¾ the actual length of the elongated conductor. The foregoing preference also applies to other embodiments described below.

Modes of antenna systems that are similar to the antenna system 102 shown in FIGS. 2–3, and that are similar to modes in which the antenna system 102 shown in FIGS. 2–3 is capable of operating are discussed below in more detail with reference to FIGS. 5–7, 9–11.

An electrical component 238 (e.g., a component of the impedance matching network 104) is shown coupled by a microstrip 240 to the signal feed conductor 222. Alternatively, the electrical component 238 is coupled to the feed conductor 222 by a transmission line embedded within the multi-layer circuit board 204. The microstrip 240 can be coupled to the signal feed conductor 222 by soldering. Similarly, the grounding conductor 224 can be coupled to the finite ground plane 202 by soldering. Other components of the communication circuit shown in FIG. 1 are not shown in FIGS. 2–3.

Not including the capacitive tabs 234, 236, 242, 252, the elongated flat conductor 206 is located in a virtual plane that is parallel to the finite ground plane 202. The signal feed conductor 222 and the grounding conductor 224 extend from the virtual plane to the finite ground plane.

Figure 4:
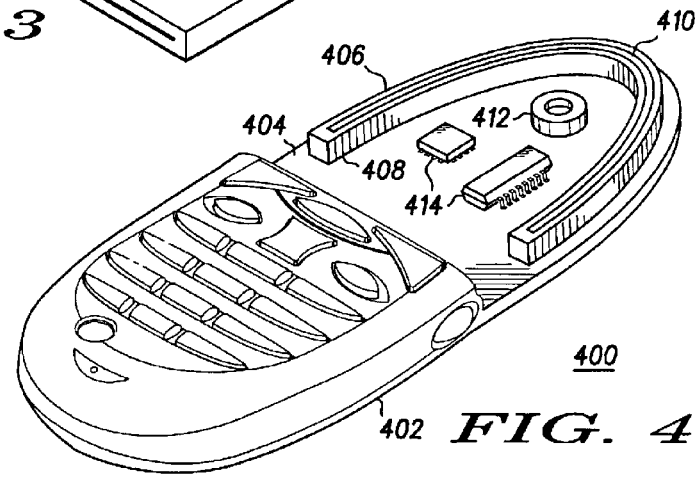
FIG. 4 is a cut-away perspective view of a wireless communication device according to a second embodiment of the invention.

FIG. 4 is a cut-away perspective view of a wireless communication device 400 according to a second embodiment of the invention. The device 400 comprises a housing 402 that encloses a multi-layer circuit board 404. The multi-layer circuit board 404 includes a finite ground plane (not shown). A rounded U-shaped elongated flat conductor 406 is supported, spaced from the multi-layer circuit board 404 by a congruent rounded U-shaped dielectric spacer 408. A rounded U-shaped slot 410 runs lengthwise along the elongated flat conductor 406. A grounding conductor and a signal feed conductor that are not visible in FIG. 4 connect the rounded U-shaped elongated flat conductor 406 to the multi-layer circuit board 404 near the apex of the conductor 406. The flat conductor 406, the finite ground plane of the multi-layer circuit board 404, the grounding conductor and the signal feed conductor are parts of an antenna system for the wireless communication device 400.

The shape of the elongated flat conductor 406, and the congruent shape of the dielectric spacer 408, match the plan view contour of the housing 402. A loudspeaker 412, and a number of other electrical components 414 (that are optionally provided with electromagnetic shields) are mounted on the multi-layer circuit board 404 between the legs of the U-shaped elongated flat conductor 406. Thus, the elongated flat conductor 406 is accommodated in a manner that is efficient in terms of the use of available space. In as much as it is desirable to make small wireless communication devices, efficient use of space is beneficial. Alternatively, the dielectric spacer 408 and the elongated conductor 406 are located on a back side of the multi-layer circuit board.

Figure 5:
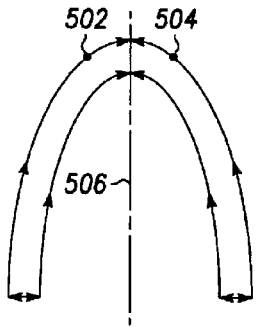
FIG. 5 is a diagram of current flow in the elongated flat conductor of the wireless communication device shown in FIG. 4 when operating in a first electromagnetic mode.
Figure 6:
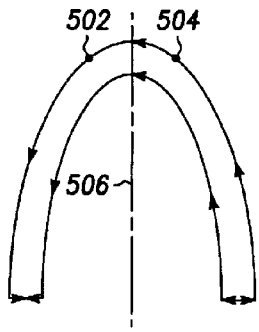
FIG. 6 is a diagram of current flow in the elongated flat conductor of the wireless communication device shown in FIG. 4 when operating in a second electromagnetic mode.
Figure 7:
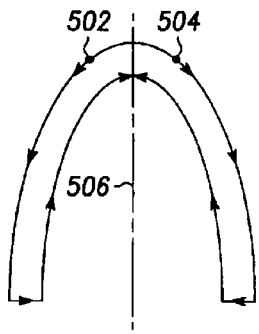
FIG. 7 is a diagram of current flow in the elongated flat conductor of the wireless communication device shown in FIG. 4 when operating in a third electromagnetic mode.

The antenna system described with reference to FIG. 4 is capable of operating in at least three radiating modes. The availability of three modes of operation allows the antenna system to be operate in at least two frequency bands. For example the antenna system can support operation in three frequency bands (e.g., for three different communication protocols) -or in four frequency bands for four different communication protocols. Three different modes of operation of the antennas system described with reference to FIG. 4, are characterized by three different patterns of current on the rounded U-shaped elongated flat conductor 406. The three patterns of current are illustrated in FIGS. 5–7. The current is periodic in time. In FIGS. 5–7 the direction of current is indicated at an instant of time. The magnitude of the current is not indicated in FIGS. 5–7, and is variable along the length of the conductor 406. Dot 502 indicates the point at which the signal feed conductor connects to the flat conductor 406, and dot 504 indicates the point at which the grounding conductor connects to the flat conductor 406. The signal feed conductor and the grounding conductor are connected to the elongated flat conductor 406 within the middle ½ (lengthwise) of the elongated flat conductor 406.

FIG. 5 is a diagram of current flow in the elongated flat conductor 406 of the wireless communication device shown in FIG. 4 when operating in a, first, common electromagnetic mode. In the common mode, current flow is symmetric with respect to an axis of symmetry 506 of the elongated flat conductor 406. Current flows in opposite directions on opposite sides of the axis of symmetry.

FIG. 6 is a diagram of current flow in the elongated flat conductor 406 of the wireless communication device shown in FIG. 4 when operating in a second, differential electromagnetic mode. In the differential mode current flow is anti-symmetric with respect to the axis of symmetry 506. In the differential mode current flows in the same direction at different points along the length of the conductor 406, at any given instant in time.

FIG. 7 is a diagram of current flow in the elongated flat conductor 406 of the wireless communication device shown in FIG. 4 when operating in a third, slot electromagnetic mode. In the slot mode current is symmetric with respect to the axis of symmetry 506, and currents on opposite sides of the slot (across the slot from each other) flow in opposite directions. High charge concentrations, and high fields crossing the slot 410 occur near the apex of the rounded U-shaped elongated flat conductor 406.

Figure 8:
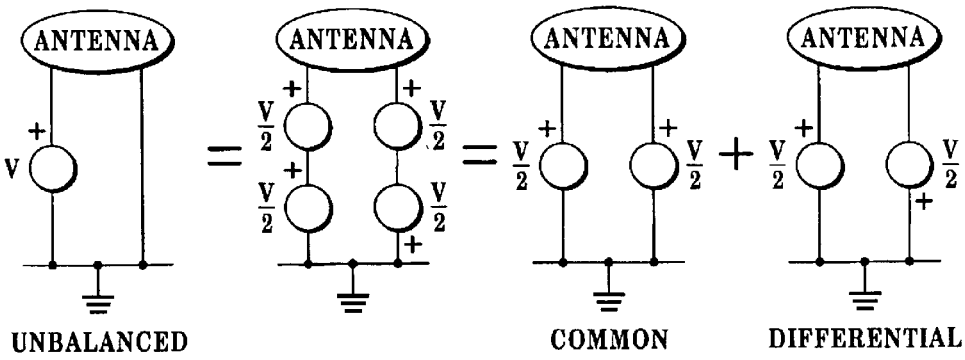
FIG. 8 is a diagram illustrating how unbalanced driving can be viewed as a superposition of differential and common mode driving.

The elongated flat conductors 206, 406 of the antennas systems shown in FIGS. 2–4 are driven in unbalanced manner by applying a signal through a signal feed conductor (e.g., 222). Nonetheless, the symmetric common mode, the anti-symmetric differential mode, and the symmetric slot mode can be driven. FIG. 8 is a diagram illustrating how unbalanced driving is a superposition of differential and common mode driving. In the antenna system illustrated in FIGS. 2–3, unbalanced connections using the signal feed conductor 222, and the grounding conductor 224 are used to couple to both symmetric and anti-symmetric modes similar to those discussed with reference to FIGS. 5–7.

Figure 9:
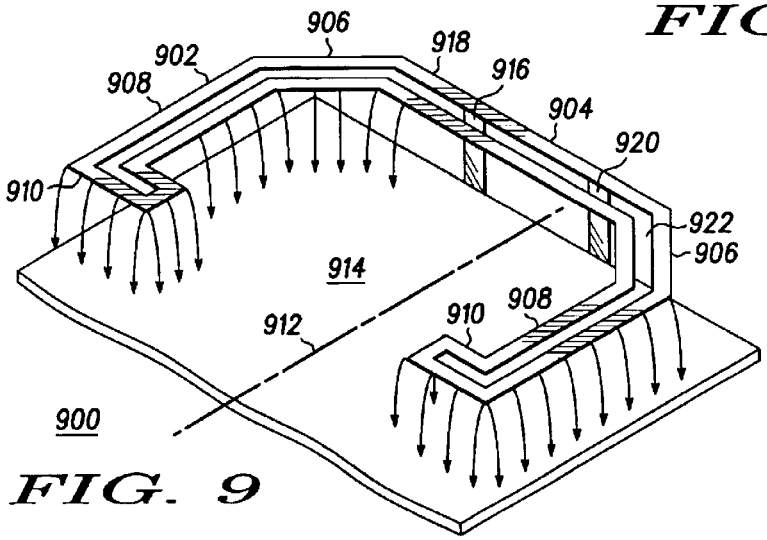
FIG. 9 illustrates electric field lines of a common electromagnetic mode of an antenna system according to a third embodiment of the invention.
Figure 10:
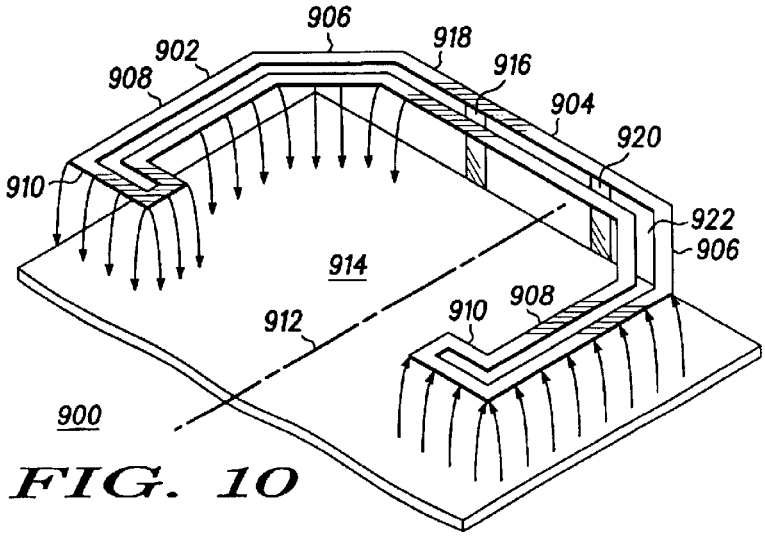
FIG. 10 illustrates electric field lines of a differential electromagnetic mode of the antenna system shown in FIG. 9.
Figure 11:
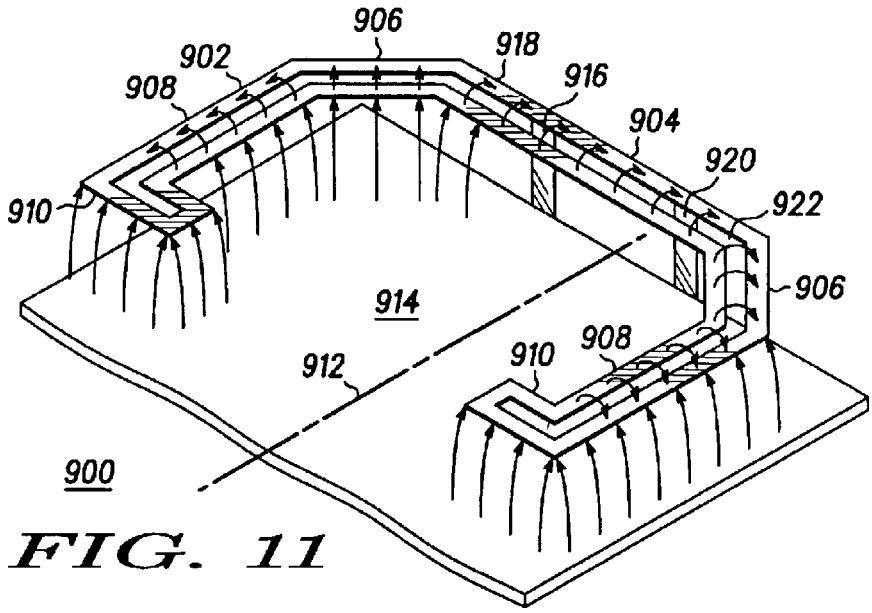
FIG. 11 illustrates electric field lines of a slot electromagnetic mode of the antenna system shown in FIG. 9.

FIGS. 9–11 illustrate electric field lines of the common mode, the differential mode, and the slot mode for an antenna system 900 according to a third embodiment of the invention. The electric fields, which are periodic in time are shown at particular moments. The antenna system 900 includes an elongated flat conductor 902, supported above a finite ground plane 914. A dielectric support for supporting the elongated flat conductor 902 is not shown in FIGS. 9–11. The elongated flat conductor 902 is generally U-shaped, and includes a base segment 904, two chamfer segments 906 that connect to the base segment 904 and extend at about a forty-five degree angle, two leg segments 908 that connect to the chamfer segments 906 and run substantially perpendicular to the base segment 904, and two end segments 910 that connect to the leg segments 908, and extend inward, substantially parallel to the base segment 904 toward an axis of symmetry 912 of the conductor 902. A slot 922 runs through the base segment, 904, through the chamfer segments 906, through the leg segments 908, and into the end segments 910.

A grounding conductor 916 connects an external (external to the U-shape) edge 918 of the base segment 904 to the finite ground plane 914. A signal feed conductor 920 extends from the external edge 918 of the base segment 904 toward the finite ground plane 914. The signal feed conductor 920 is preferably coupled to communication circuits (not shown) for driving modes of the antenna system 900, or receiving signal energy therefrom. Such communication circuits are preferably supported above or below the finite ground plane 914, and can be located within the area that is partially circumscribed by the generally U-shaped flat conductor 902. Vias can be formed through the finite ground plane 914 for connecting to circuitry supported below the finite ground plane 914.

FIG. 9 illustrates electric field lines of the common electromagnetic mode of the antenna system 900. In the common mode, electric field vectors extend between the elongated flat conductor 902 and the finite ground plane 914. In the common mode, the electric fields are substantially symmetric about the symmetry axis 912. In the common mode, the electric field vectors between different parts of the conductor 902 and the finite ground plane 914 generally point in the same direction (i.e., toward or away from the finite ground plane 914) at any given instant. In common mode current flowing in the finite ground plane 914 includes a substantial component oriented parallel to the symmetry axis 912.

FIG. 10 illustrates electric field lines of the differential electromagnetic mode of the antenna system 900 shown in FIG. 9. In the differential mode, the electric field is substantially anti-symmetric about the symmetry axis 912. At the moment shown, the electric field points toward the finite ground plane 914 on the right side of the symmetry axis 912, and towards the elongated flat conductor 902 on the left side of the symmetry axis 912. Note that even in alternative embodiments in which the antenna does not exhibit bilateral symmetry, there will be some point along the length of elongated conductor, on one side of which the electric field points in one direction (e.g., up) and on an opposite side of which the electric field points in the opposite direction (e.g., down) when operating in the differential mode. In the symmetric antenna system 900 illustrated in FIG. 9, this point is coincident with or close to the point at which the symmetry axis 912 crosses the conductor 902.

FIG. 11 illustrates electric field lines of the slot electromagnetic mode of the antenna system 900 shown in FIG. 9. In the slot mode a strong electric field crosses the slot 922, and the electric field is substantially symmetric about the symmetry axis 912.

The three modes illustrated in FIGS. 9–11 correspond to three frequency bands that are used to support different communication channels each of which may use a different communication protocol. The transmitters and receivers of the wireless device with which the antenna system 900 is used preferably operate at frequencies in bands associated with each of the three modes.

Figure 12:
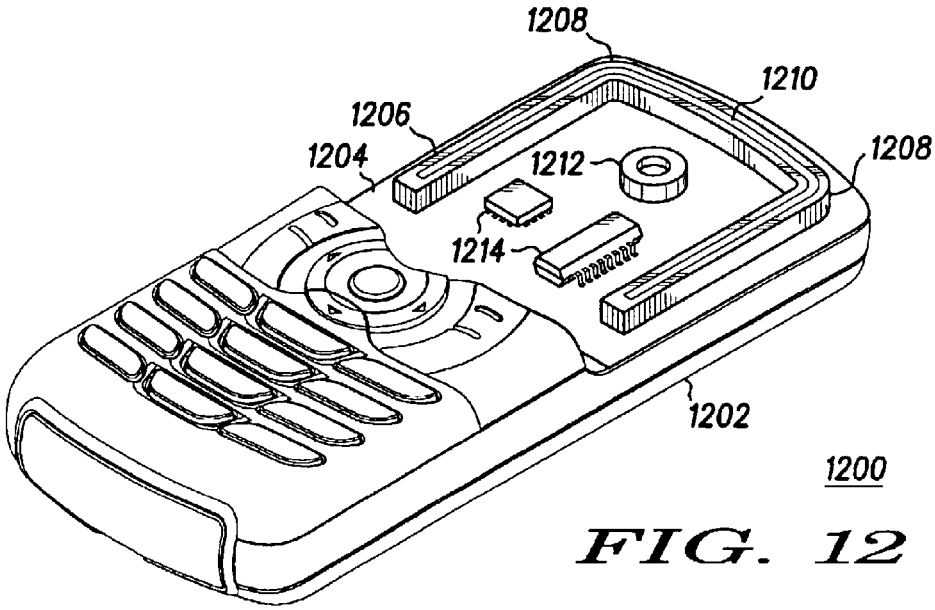
FIG. 12 is a wireless communication device according to a fourth embodiment of the invention.

FIG. 12 is a wireless communication device 1200 according to a fourth embodiment of the invention. The wireless communication device 1200 includes a housing 1202 enclosing a multi-layer circuit board 1204. The housing 1202 is rectangular. An antenna system comprises a rectilinear U-shaped elongated flat conductor 1206, and a finite ground plane (not shown) that is a layer of the multi-layer circuit board 1204. A signal feed conductor and a grounding conductor (not shown) similar to those illustrated in FIGS. 9–11 are also provided. The elongated flat conductor 1206, includes two right angle comers 1208 so as to match the contour of the rectangular housing 1202. A slot 1210 runs along the length of the elongated flat conductor. The elongated flat conductor 1206 is supported above the multi-layer circuit board 1204 by a congruently shaped dielectric spacer (not shown). A loud speaker 1212, and other shielded electrical components 1214 are mounted within the area that is partially circumscribed by the elongated flat conductor 1208. The antenna system of the wireless communication device 1200 is capable of operating in modes similar to those described with reference to FIGS. 5–7, 9–11, and thereby support multi-band communication. The elongated flat conductor 1208, along with the finite ground plane, and signal feed, and grounding conductors serve as a space efficient, multi-band antenna system for the wireless communication device 1200.

Figure 13:
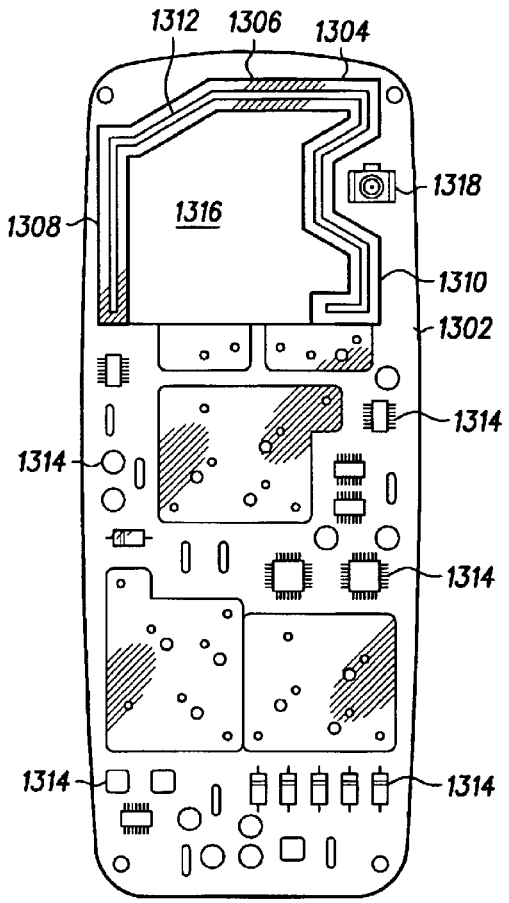
FIG. 13 is a wireless communication device according to a fifth embodiment of the invention.

FIG. 13 is a wireless communication device 1300 according to a fifth embodiment of the invention. The wireless communication device 1300 is shown from the back with the back part of the housing removed. The wireless communication device 1300 includes an antenna system that includes a finite ground plane (not shown) of a multi-layer circuit board 1302 and an elongated, generally U-shaped, flat conductor 1304 that is supported spaced from the multi-layer circuit board 1302 by a dielectric spacer 1316. The flat conductor 1304 includes a base segment 1306, a first leg segment 1308 that is connected to the base segment 1306, and a second leg segment 1310 that is connected to the base segment 1306. A slot 1312 that enables the flat conductor to support the slot mode runs longitudinally along the length of the flat conductor 1304. A signal feed conductor (not shown) and a grounding conductor (not shown) connect to the outer edge of the base segment 1306 for coupling signals to and from the flat elongated conductor 1304. The path of the flat conductor 1304 is contorted in order to accommodate the placement of various components including connector 1318 on the multi-layer circuit board 1302. The nature of the antenna system is such that the contorting of the flat conductor 1304, does not adversely effect the antenna system's performance. The multi-layer circuit board 1302 also supports and electrically interconnects a plurality of circuit components, e.g., 1314.

Figure 14:
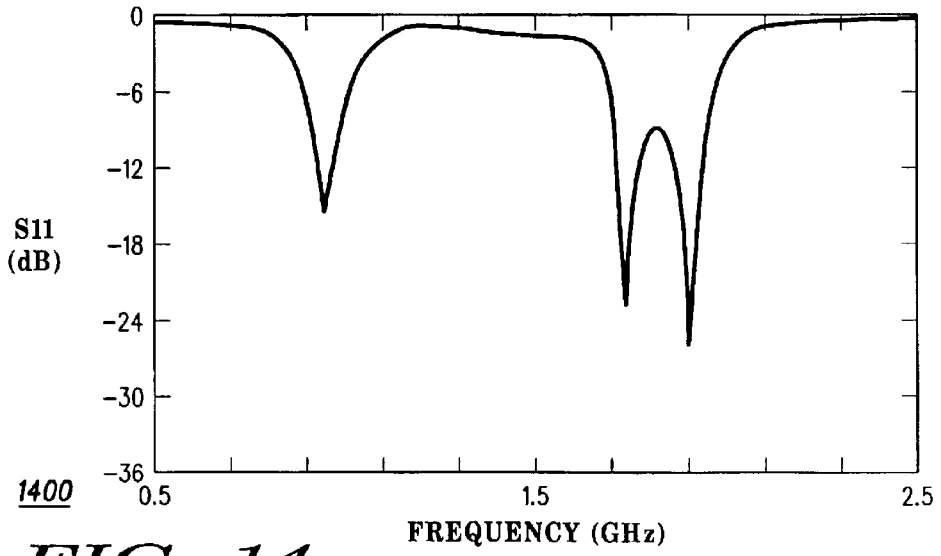
FIG. 14 is a return loss plot for the antenna system of the wireless communication device shown in FIG. 13.

FIG. 14 is a return loss plot 1400 for the antenna system of the wireless communication device shown in FIG. 13. The return loss 1400 exhibits a first band of operation centered at about 935 Mhz. The latter band which is due to the common mode described above can for example be used for GSM communication in the nominal 900 MHz band. The return loss diagram further exhibits a second wider band of operation that is attributable to a resonance centered at 1730 Mhz that is due to the differential mode described above, and another resonance centered at about 1900 MHz that is due to slot mode described above. The second band of operation can for example be used for GSM communication in the nominal 1800 MHz and 1900 MHz bands and for UMTS communication. Thus, the antenna system of the device 1300 shown in FIG. 13 is able to support communications in a plurality of frequency bands.

Figure 15:
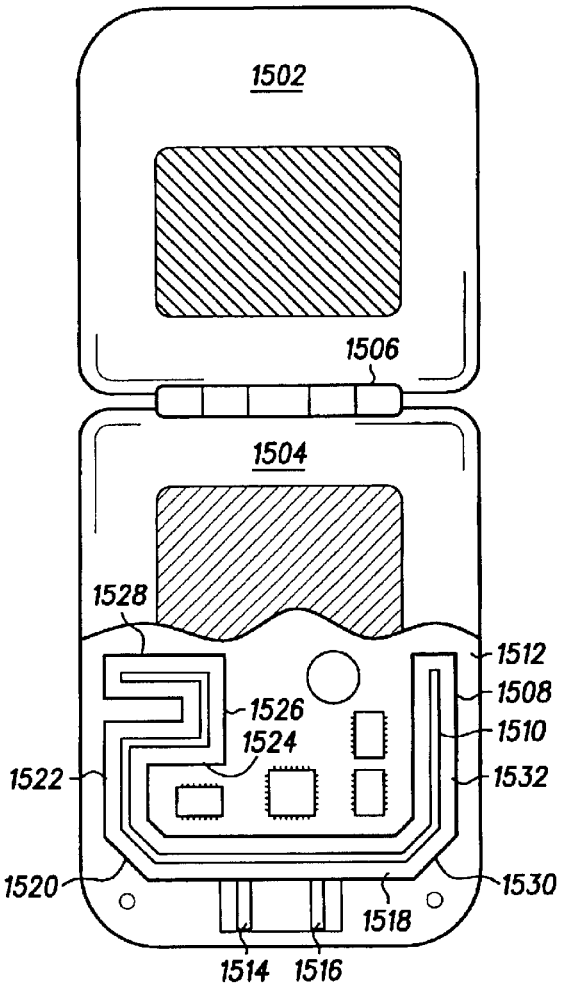
FIG. 15 is a cut-away view of a clamshell type wireless communication device according to a sixth embodiment of the invention.

FIG. 15 is a cut-away view of a clamshell type wireless communication device 1500 according to a sixth embodiment of the invention. The clamshell type wireless communication device 1500 comprises an upper half (or flip) 1502, and a lower half 1504 that are attached by a hinge 1506.

The lower half 1504 encloses an antenna system that includes an elongated flat conductor 1508 that includes a longitudinal slot 1510. The elongated flat conductor 1508 is supported above a circuit board 1512 that includes a finite ground plane by a congruently shaped dielectric spacer (not shown). The finite ground plane (not shown) is also part of the antenna system. A signal feed conductor 1514 and a grounding conductor 1516 extend from the circuit board 1512 to the elongated flat conductor 1508. The conductor 1508, includes a base segment 1518, a first angled segment 1520 connected to the base segment 1518, and oriented at about forty-five degree relative to the base segment 1518 (toward the upper half, 1502), a third segment 1522 connected to the angled segment 1520, oriented substantially perpendicular to the base segment 1518 and extending toward the upper half 1502, a fourth segment 1524 connected to the third segment 1522 that extends inward substantially parallel to the base segment 1518, a fifth segment 1526 that is connected to the fourth segment 1524 and runs substantially perpendicular to and away from the base segment 1518, and a sixth segment 1528 that is connected to the fifth segment 1526 and runs substantially parallel to base segment 1518 toward the outside of the device 1500. The conductor 1518 further comprises a second angled segment 1530 that is connected to the base segment 1518 opposite the first angled segment 1520, an eighth segment 1532 that is connected to second angled segment 1530 and extends substantially perpendicular to the base segment 1518 (toward the upper half 1502). The above described path of the conductor 1508 allows the conductor 1508 to be accommodated in a space efficient manner.

Figure 16:
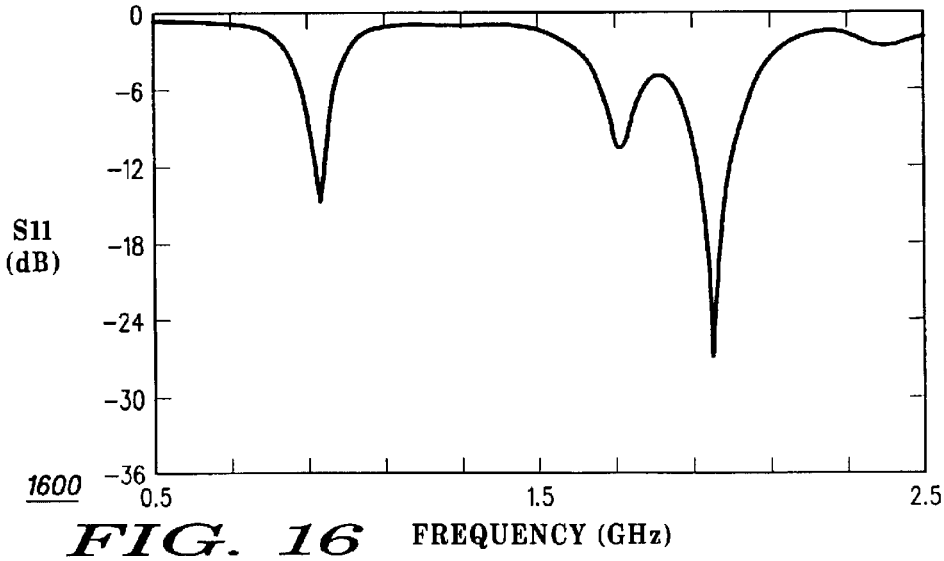
FIG. 16 is a return loss plot for the wireless communication device shown in FIG. 15 when the flip is closed.

FIG. 16 is a return loss plot 1600 for the wireless communication device shown in FIG. 15 when the flip is closed, i.e., when the upper 1502 and lower 1504 halves are brought together by rotating about the hinge 1506. The wireless communication device 1500 is usually in this configuration when it is in standby mode waiting to receive signals through the antenna system of the device 1500. The return loss plot exhibits three bands of operation that are due to the common mode, the differential mode, and the slot mode of the antenna system. A first band centered at 920 Mhz is due to the common mode, a second band centered at about 1710 MHz is due to differential mode, and a third band centered at about 1920 MHz is due to the slot mode.

FIG. 17 is a broad band impedance matching circuit 1700 for use in the wireless communication device shown in FIG. 15 according to a seventh embodiment of the invention. The impedance matching network 1700 is preferably coupled between the antenna system of the communication device 1500, and a duplexer that is also part of the communication device 1500 (as in the case of the wireless communication device 100). The impedance matching network 1700 comprises a first input terminal 1702 and a second input terminal 1704 to which the duplexer of the wireless communication device 1500 is coupled. The first terminal 1702 is coupled through a series of a first capacitor 1706, and a second capacitor 1708, to the signal feed conductor 1514. An inductor 1712 couples the junction of the first 1706 and second 1708 capacitors to ground. As shown in FIG. 17, the grounding conductor 1516 as well as the second input terminal 1704 are also coupled to ground (i.e. to the finite ground plane of the circuit board 1512).

Alternatively, instead of using a fixed impedance matching circuit, a reconfigurable impedance matching network that has different configurations for a each of a plurality of the modes of the antenna system of the wireless communication device 1500 is provided.

Figure 18:
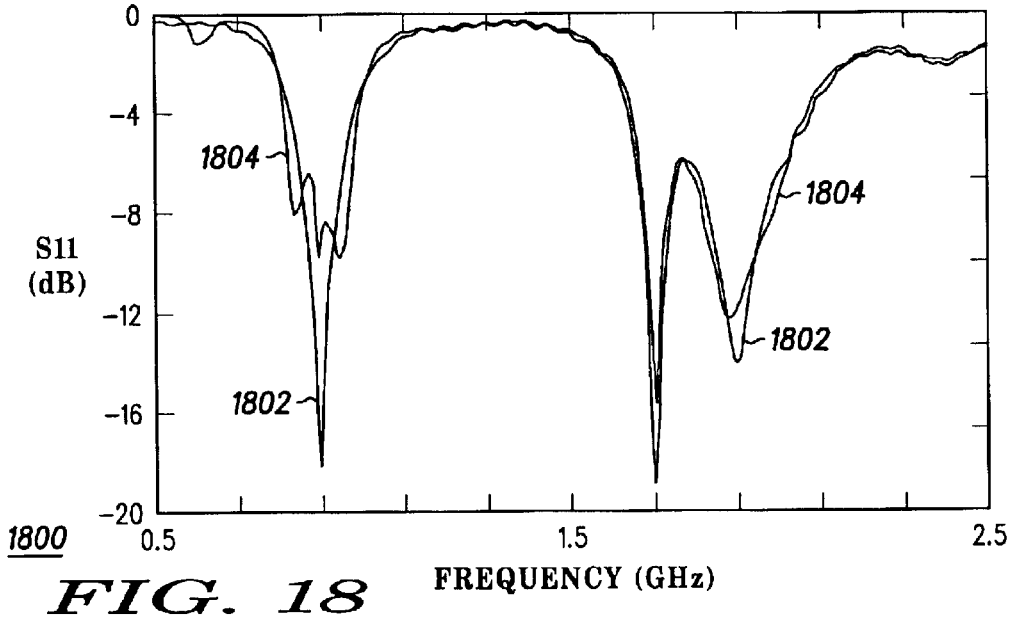
FIG. 18 is a graph including return loss plots for the wireless communication device shown in FIG. 15 with the flip open, with and without the matching circuit shown in FIG. 17.

FIG. 18 is a graph 1800 including return loss plots for the wireless communication device shown in FIG. 15 with the flip open, with and without the matching circuit shown in FIG. 17. A first plot 1802 is the return loss without the impedance matching circuit. The same bands that are present when the flip is closed remain, although depth of the return loss is somewhat increased. A second plot 1804 is the return loss when using the impedance matching circuit shown in FIG. 17. Using the impedance matching circuit 1700 increases the width of the band centered at about 900 MHz, so that that band can be used to support higher bandwidth communication and/or to support more channels.

Figure 19:
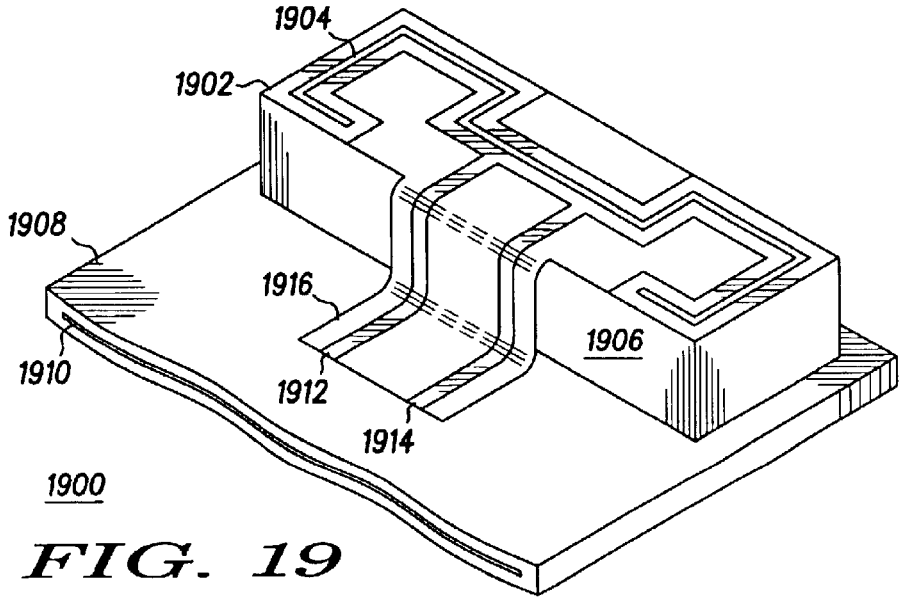
FIG. 19 is a perspective view of an antenna system according to an eighth embodiment of the invention.

FIG. 19 is a perspective view of an antenna system 1900 according to an eighth embodiment of the invention. The antenna system 1900 comprises a rectilinearly meandering elongated flat conductor 1902 that includes a slot 1904 that runs through a substantial portion of its length. The elongated flat conductor 1902 is supported by a dielectric spacer 1906 above a circuit board 1908 that includes a finite ground plane 1910. The elongated flat conductor 1902 is located in a virtual plane that is substantially parallel to the finite ground plane 1910. A grounding conductor 1912 extends from the circuit board 1908 to the elongated flat conductor 1902. The grounding conductor 1912 is connected to the finite ground plane 1910 (e.g., through a via, not shown) at the circuit board 1908. A signal feed conductor 1914 extends from the circuit board 1908 at which it is connected to communication circuits (not shown, in FIG. 19) to the elongated conductor 1902. The elongated conductor 1902, the grounding conductor 1912, and the signal feed conductor 1914 are formed on a flexible substrate 1916.

The rectilinearly meandering path of the elongated flat conductor shown in FIG. 19 can be varied. FIGS. 20–21, 23, 27 show alternative paths.

Figure 20:
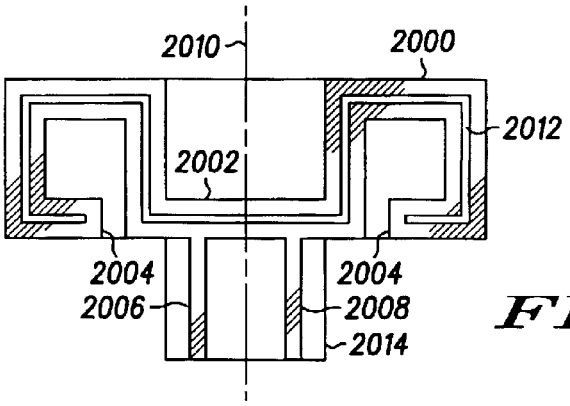
FIG. 20 is a plan view of an elongated flat conductor, signal feed conductor, and grounding conductor for the antenna systems shown in FIGS. 19, 23 according to a ninth embodiment of the invention.

FIG. 20 is a plan view of an elongated flat conductor 2000 for the antenna systems shown in FIGS. 19, 23 according to an ninth embodiment of the invention. As shown in FIG. 20 the elongated flat conductor 2000 includes a base segment 2002. Continuing from both ends of the base segment 2002, the elongated flat conductor 2000 turns through four right angle turns forming a square, with a small open gap remaining between the ends 2004 of the conductor 2000 and the base section 2002. A grounding conductor 2006, and a signal feed conductor 2008 are connected to the base segment 2002, and are located symmetrically relative to an axis of symmetry 2010 of the elongated flat conductor 2000. A slot 2012 runs through a substantial portion of the length of the elongated flat conductor 2000. The elongated flat conductor 2000, the grounding conductor 2006, and the signal feed conductor 2008 are supported on a flexible dielectric substrate 2014.

Figure 21:
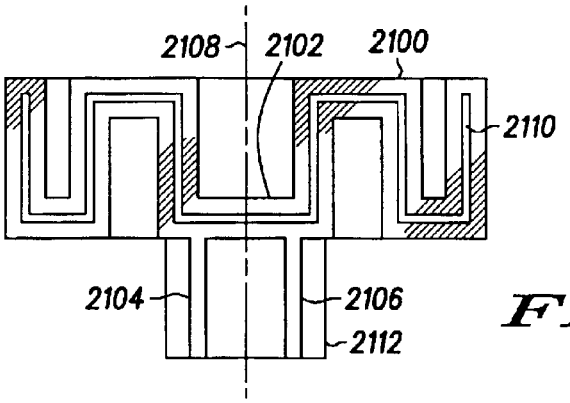
FIG. 21 is a plan view of an elongated flat conductor, signal feed conductor, and grounding conductor for the antenna systems shown in FIGS. 19, 23 according to a tenth embodiment of the invention.

FIG. 21 is a plan view of an elongated flat conductor 2100 for the antenna systems shown in FIGS. 19, 23 according to a tenth embodiment of the invention. As shown in FIG. 21 the flat conductor 2100 follows a rectilinear serpentine path. The conductor 2100 includes a base segment 2102, to which a signal feed conductor 2104, and a grounding conductor 2106 are connected, at points that are symmetrically placed relative to a symmetry axis 2108. A slot 2110 runs through a substantial portion of the length of the elongated conductor 2100. The elongated flat conductor 2100, the grounding conductor 2106, and the signal feed conductor 2104 are supported on a flexible dielectric substrate 2112.

The elongated conductors 2000, 2100 make efficient use of space while still enabling the support of the common, differential, and slot modes, thereby providing for compact multi-band antennas.

Figure 22:
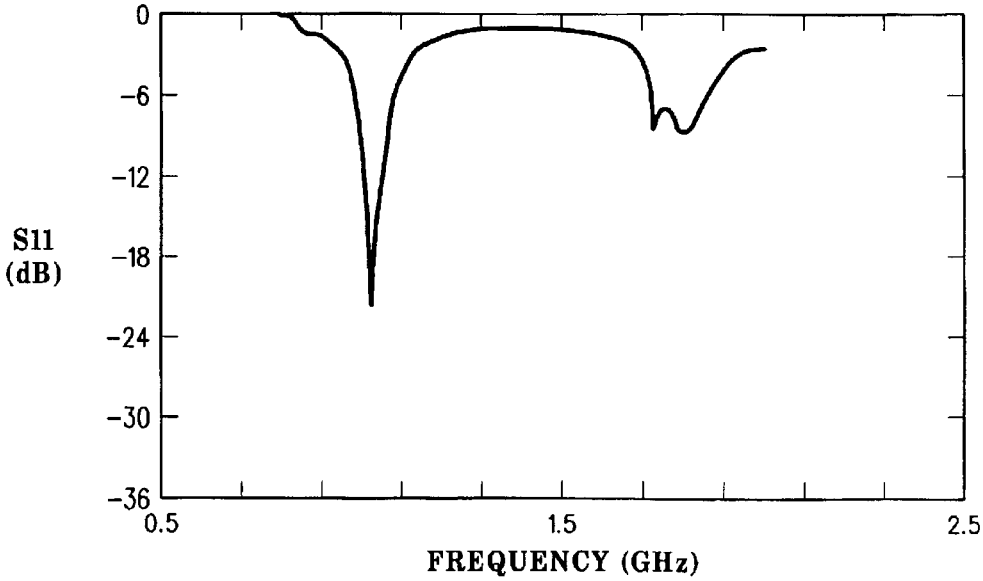
FIG. 22 is a return loss plot of an antenna system of the type shown in FIG. 19 using the elongated flat conductor shown in FIG. 21.

FIG. 22 is a return loss plot 2200 of an antenna system of the type shown in FIG. 19 using the elongated flat conductor shown in FIG. 21. The return loss plot 2200 exhibits a first band 2202 that is due to the common mode, and a second band 2204 that is due in part to the differential mode, and in part to the slot mode. These bands are relatively wide and can accordingly support relatively high bandwidth communications, and/or a high number of communication channels.

FIG. 23 is an antenna system 2300 according to an eleventh embodiment of the invention. The antenna system 2300 comprises an elongated flat conductor 2302 that is supported on a dielectric spacer 2304. The elongated flat conductor 2302 follows a serpentine contour, and includes a longitudinal slot 2306. The dielectric spacer 2304 includes a top surface 2308 that is opposite the circuit board 1908, and supports the elongated flat conductor 2302. The top surface 2308 is curved in three-dimensional space so as to better conform to a similarly curved wireless communication device housing 2414 (FIG. 24) in which the antenna system 2300 is preferably enclosed. Thus, the serpentine contour of the elongated flat conductor 2302 also follows a path in three dimensional space. In other words the path of the elongated flat conductor 2302 is located in a curved surface. Vector normals of the elongated flat conductor 2302 (e.g., 2310, 2312) include at least a substantial vector component in the direction parallel to the surface normal of the finite ground plane 1910, over at least substantial portion of the length of the conductor 2302. The latter angular relation fosters capacitive interaction between the conductor 2302 and the ground plane 1910, and thereby facilitates operation in the common and differential modes. Stated otherwise, the projected area of the elongated flat conductor 2302 on the ground plane 1910 is a substantial fraction of the area of the elongated flat conductor 2302. The curvature of the top surface facilitates space-efficient installation of the antenna system 2300 in a wireless communication device.

FIG. 24 is a sectional side view of a wireless communication device 2400 including the antenna system 2300 shown in FIG. 23. The wireless communication device 2400 includes a microphone 2402, a keypad 2404, a display 2406, a speaker 2408, a battery 2410, the circuit board 1908 and a plurality of electrical circuit components 2412, held in a housing 2414. The electrical circuit components 2412 which make up communication circuits are supported by and interconnected by the circuit board 1908. The antenna system 2300 is included in the wireless communication device 2400. The top surface 2308 of the dielectric spacer 2304 conforms to the shape of the housing 2414, thereby facilitating inclusion of the antenna system 2300 in the wireless communication device 2400 in a space efficient manner.

FIG. 25 is plan view of an elongated flat conductor 2500 for the antenna system shown in FIGS. 2–3 according to an twelfth embodiment of the invention. The elongated flat conductor 2500 is U-shaped, and comprises a plurality of linear segments, including a base segment 2502. A U-shaped slot 2504 runs along the length of the elongated flat conductor 2500. A signal feed conductor 2506, and grounding conductor 2508 attach to an outer edge 2510 of the base segment 2502 at points that are approximately symmetrically placed relative to a symmetry axis of the elongated flat conductor 2500. A capacitive gap 2512 extends from the slot 2504 out to the outer edge 2510 of the base segment. Alternatively, the capacitive gap is placed on the opposite side of the slot 2504. A dielectric slab 2514 covers the capacitive gap 2512. The dielectric slab 2514 serves to increase the capacitance of the capacitive gap 2514. Alternatively, the dielectric slab 2514 is not used. Alternatively, the capacitive effect is enhanced by placing a short, flat conductive strip over a thin dielectric film across the gap. Alternatively, the capacitive gap 2512 takes the form of interdigitated fingers. Alternatively, a discrete capacitor component is connected across the gap 2512. Reducing the capacitance of the capacitive gap 2512 serves to decrease the effective electrical length of the elongated flat conductor 2500 with respect to the slot mode. Therefore, by controlling the capacitance of the capacitive gap 2512 the frequency of the band associated with the slot mode relative to the frequency of the bands due to the common and differential modes can be controlled. The capacitance of the capacitive gap 2512 is preferably at least about 0.5 Pico farads.

The U-shaped elongated flat conductor 2500 having the U-shaped slot 2504, and the capacitive gap 2512, can be viewed as an elongated conductor that but for the gap 2512 circumscribes a U shaped swath area (i.e., the area of the slot 2504). In using the elongated flat conductor shown in FIG. 25 for the antenna system depicted in FIGS. 2–3, the vector normal to the swath area is parallel to the vector normal to the finite ground plane 202. Alternatively, the elongated flat conductor 2500 is supported on a dielectric spacer that curves in three dimensional space.

Figure 26:
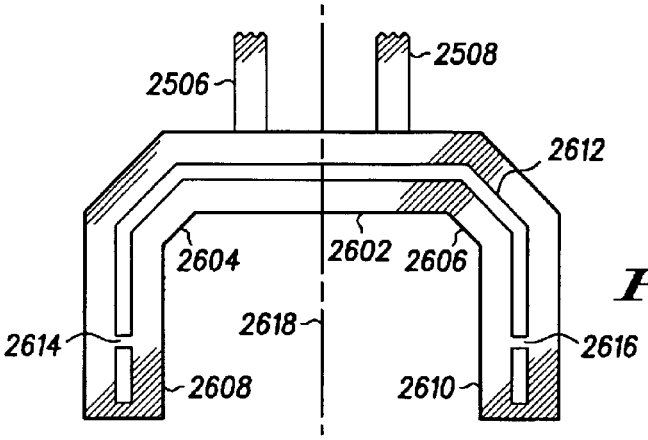
FIG. 26 is plan view of an elongated flat conductor for the antenna system shown in FIGS. 2–3 according to a thirteenth embodiment of the invention.

FIG. 26 is plan view of an elongated flat conductor 2600 for the antenna system shown in FIGS. 2–3 according to a thirteenth embodiment of the invention. The elongated flat conductor 2600 is generally U-shaped and includes a base segment 2602, a first angled segment 2604, and a second angled segment 2606 connected to the base segment 2602, and a first leg segment 2608 and a second leg segment 2610 connected to the first and second angled segments 2604, 2606 respectively. An elongated slot 2612 runs through a substantial portion of the elongated flat conductor 2600. The elongated slot 2612 is interrupted by a first short 2614 in the first leg segment 2608 and by a second short 2616 in the second leg segment 2610. The shorts 2614, 2616 are preferably, as shown, symmetrically placed relative to an axis of symmetry 2618 of the elongated flat conductor 2600. The shorts 2614, 2616 serve to reduce the effective electrical length of the slot 2612 as it effects the slot mode, while not substantially altering the electrical length of the elongated flat conductor 2600, as effects the differential and common mode. The provision of the shorts thus provides another way of adjusting the frequency of the operating band associated with the slot mode.

Alternatively, the shorts 2614, 2616 are made separately from the elongated flat conductor and are placed across the elongated slot 2612 in order to effect tuning. According to another alternative embodiment rather than using true shorts, conductive strips that are separated from the conductor 2600 by a thin dielectric film, and thus strongly capacitively coupled to the conductor 2600 are used.

Figure 27:
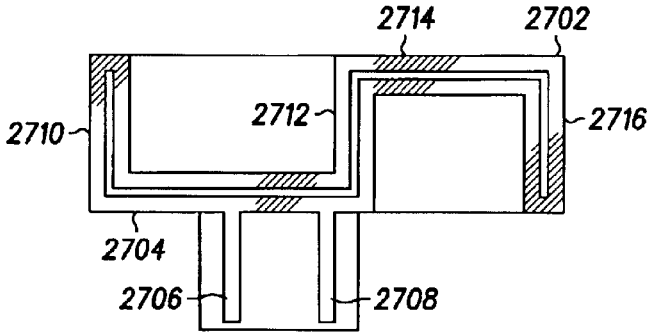
FIG. 27 is a plan view of an elongated flat conductor for the antenna systems shown in FIGS. 19, 23 according to a fourteenth embodiment of the invention.

FIG. 27 is a plan view of an elongated flat conductor 2702, a signal feed conductor 2706 and a grounding conductor 2708 for the antenna systems shown in FIGS. 19, 23 according to a fourteenth embodiment of the invention. The elongated flat conductor 2702 includes a first transverse segment 2704 to which a signal feed conductor 2706, and a grounding conductor 2708 are attached at right angles. A first vertical (in the perspective of FIG. 27) segment 2710 is connected to a first end of the first transverses segment 2704 at a right angle and extends upward. A second vertical segment 2712 is connected to a second end of the first transverse segment 2704 and extends upward. A second transverse segment 2714 is connected to an end of the second vertical segment 2712 opposite from the first transverse segment 2704. The second transverse segment 2714 runs substantially parallel to the first transverse segment 2704 but in the opposite direction (from the second vertical segment 2712). A third vertical segment 2716 is connected at a right angle to the second transverse segment 2714 opposite from the second vertical segment 2712. The third vertical segment 2716 extends downward. In contrast to the elongated conductors shown in FIGS. 19–21,23, the conductor of FIG. 27 does not exhibit bilateral symmetry.

Figure 28:
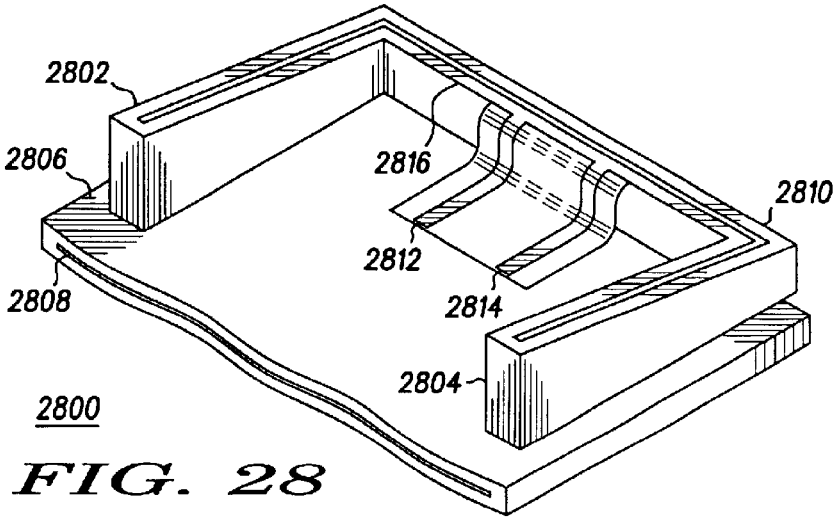
FIG. 28 is a perspective view of an antenna system according to a fifteenth embodiment of the invention.

FIG. 28 is an antenna system 2800 according to a fifteenth embodiment of the invention. The antenna system comprises an U-shaped elongated flat conductor 2802, that is supported on a truncated wedge shaped dielectric spacer 2804 over a circuit board 2806 that includes a finite ground plane 2808. The U-shaped elongated flat conductor is located in a virtual plane that is characterized by a vector normal that is angled with respect to the vector normal of the finite ground plane 2808. However, the angle is such that the vector normal of the virtual plane within which the U-shaped elongated flat conductor 2802 is located includes a substantial component parallel to the vector normal of the finite ground plane. The latter relation is beneficial to allowing the antenna system 2800 to operate in the common, and differential modes. On the other hand, angling the orientation of the U-shaped elongated flat conductor 2802 to some extent, allows the antenna system 2800 to be accommodated in a space efficient manner in a wireless communication device having a tapered housing, similar to housing 2414 (FIG. 24). A base segment 2810 of the elongated flat conductor 2802 partially overhangs the ground plane 2808. A signal feed conductor 2812 for connecting the elongated flat conductor to a communication circuitry (not shown in FIG. 28), and a grounding conductor 2814 for connecting the elongated flat conductor 2802 to the ground plane 2808 are connected to an internal edge 2816 (internal to U-shape) of the base segment 2810.

Figure 29:
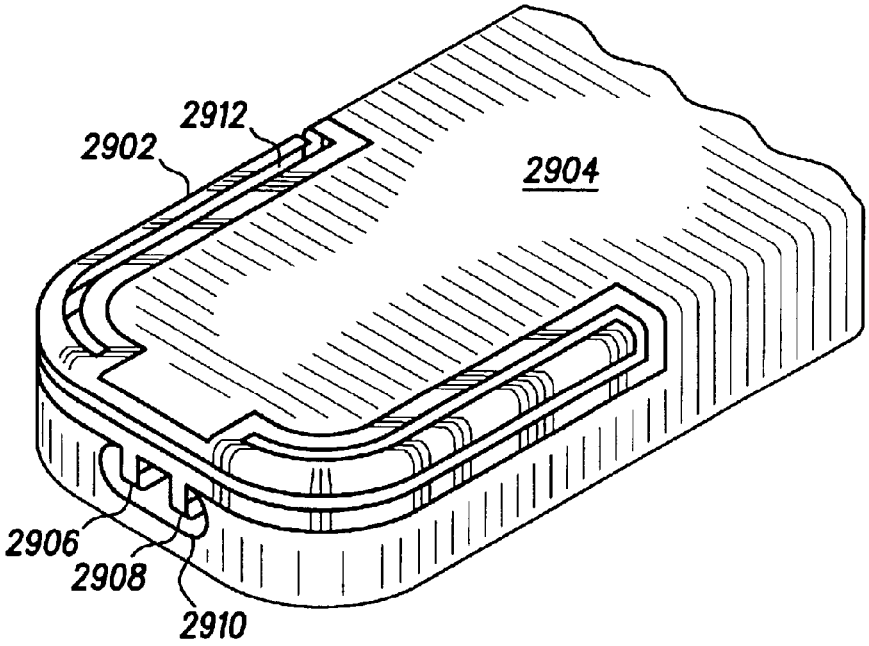
FIG. 29 is a perspective view of an elongated conductor of an antenna system according to a sixteenth embodiment of the invention.

FIG. 29 is a perspective view of an elongated conductor 2902 of an antenna system according to a sixteenth embodiment of the invention. The elongated conductor 2902 conforms to a rounded edge of a housing 2904 of a wireless communication device. A ground plane (not shown) that works in conjunction with the elongated conductor 2902 is enclosed within the housing 2904. The ground plane is arranged in like manner to the embodiment shown in FIGS. 2–3, such that the path of the elongated conductor 2902 runs substantially parallel to, though displaced from the ground plane. A grounding conductor 2906, and a signal feed conductor 2908 pass through an opening 2910 in the housing, and reach a printed circuit board (not shown) of which the ground plane is a layer. The elongated conductor 2902 includes an elongated slot 2912. The elongated conductor 2902 curves over the rounded edge of the housing 2904 so that part of the elongated conductor 2902 is oriented parallel to the ground plane (not shown) and part is oriented perpendicular to the ground plane. According to an alternative embodiment of the invention, the antenna is supported on an inside surface of the housing 2904.

While the preferred and other embodiments of the invention have been illustrated and described, it will be clear that the invention is not so limited. Numerous modifications, changes, variations, substitutions, and equivalents will occur to those of ordinary skill in the art without departing from the spirit and scope of the present invention as defined by the following claims.

What is claimed is:

1. A wireless communication device comprising:

an antenna system comprising:

a finite ground surface, wherein the ground surface comprises a ground plane;

an elongated conductor that is characterized by a length and is spaced from the finite ground surface, wherein the elongated conductor follows a path in a virtual plane, wherein the virtual plane is tilted with respect to the ground plane, wherein the elongated conductor is supported on the ground plane by a truncated wedge shaped dielectric spacer, wherein the elongated conductor comprises a slot that extends through a substantial portion of the length of the elongated conductor;

a grounding conductor coupling the finite ground surface to the elongated conductor;

a signal feed conductor coupling to the elongated conductor, and a housing with a tapered portion for accommodating the elongated conductor supported on the truncated wedge shaped dielectric spacer.

2. A wireless communication device comprising:

an antenna system comprising:

a finite ground surface;

an elongated conductor that is characterized by a length and is spaced from the finite ground surface, wherein the elongated conductor follows a path in a surface that curves in three dimensional space; wherein the elongated conductor comprises:

a slot that extends through a substantial portion of the length of the elongated conductor;

a grounding conductor coupling the finite ground surface to the elongated conductor; and a signal feed conductor coupling to the elongated conductor; and a housing including a portion that complements the shape of the surface.

3. A wireless communication device comprising:

an antenna system comprising:

a finite ground surface;

an elongated conductor that is characterized by a length and is spaced from the finite ground surface, wherein the elongated conductor includes:

a first end;

a second end;

a side edge; and slot that extends through a substantial portion of the length of the elongated conductor;

a grounding conductor coupling the finite ground surface to the elongated conductor, wherein the grounding conductor connects to the side edge at a first point that is between the first end and the second end; and a signal feed conductor coupling to the elongated conductor, wherein the signal feed conductor connects to the same side edge at a second point of the elongated conductor that is between the first end and the second end; and wherein the first point and the second point are within a middle ½ longitudinal portion of the elongated conductor.

4. The wireless communication device according to claim 3 wherein:

the first point and the second point are separated by between 4 and 30 millimeters.

5. The wireless communication device according to claim 3 further comprising:

a capacitive tab that extends from the elongated conductor, between signal feed conductor and the grounding conductor toward the finite ground surface.

6. A wireless communication device comprising:

an antenna system comprising:

a finite ground surface;

an elongated conductor that is characterized by a length and is spaced from the finite ground surface, wherein the elongated conductor comprises:

a slot that extends through a substantial portion of the length of the elongated conductor;

a grounding conductor coupling the finite ground surface to the elongated conductor; and a signal feed conductor coupling to the elongated conductor, wherein a first capacitance enhancing clement is located proximate a first end of the elongated conductor for establishing a first capacitance between the elongated conductor and the finite ground surface;

wherein a second capacitance element located proximate a second end of the elongated conductor for establishing a second capacitance between the elongated conductor and the finite ground surface;

and wherein the first capacitance differs from the second capacitance.

7. A wireless communication device comprising:

an antenna system comprising:

a finite ground surface;

an elongated conductor that is characterized by a length and is spaced from the finite ground surface, wherein the elongated conductor comprises:

a slot that extends through a substantial portion of the length of the elongated conductor; and an elongated flat conductor; wherein the elongated flat conductor is separated from the ground surface by a congruently shaped dielectric spacer;

a grounding conductor coupling the finite ground surface to the elongated conductor;

a signal feed conductor coupling to the elongated conductor; and one or more capacitive tabs extending from the elongated flat conductor toward the finite ground surface.

8. The wireless communication device according to claim 7 wherein:

the elongated flat conductor is U-shaped.

9. A wireless communication device comprising:

an antenna system comprising:

a finite ground surface;

an elongated conductor that is characterized by a length and is spaced from the finite ground surface, wherein the elongated conductor includes:

a first end, a second end, a point intermediate the first end and the second end; and a slot that extends through a substantial portion of the length of the elongated conductor;

a grounding conductor coupling the finite sound surface to the elongated conductor; and a signal feed conductor coupling to the elongated conductor; and a communication circuit coupled to the signal feed conductor, wherein the communication circuit is capable of processing signals at a first frequency, a second frequency and a third frequency; and wherein the antenna system supports:

a first common mode, at the first frequency, in which at any given instant current summed over the cross section of the elongated conductor passes in the elongated conductor in opposite directions in longitudinal sections that are on opposite sides of the point;

a second differential mode, at the second frequency, in which at any given instant current runs in a common direction on the elongated conductor; and a third slot mode, at the third frequency, in which at any given instant current runs in opposite directions on opposite sides of the slot.

10. The wireless communication device according to claim 9 wherein:

the slot is between one-quarter and one times a free space wavelength associated with the third frequency.

11. The wireless communication device according to claim 10 wherein:

the slot is between one-half and three-quarters the free space wavelength.

12. A wireless communication device comprising:

an antenna system comprising:

a finite ground surface;

an elongated conductor that is characterized by a length and is spaced from the finite ground surface, wherein the elongated conductor includes:

a first end, a second end, a point intermediate the first end and the second end, and a slot that extends through a substantial portion of the length of the elongated conductor;

grounding conductor coupling the finite ground surface to the elongated conductor; and a signal feed conductor coupling to the elongated conductor; and a communication circuit coupled to the antenna system wherein the communication circuit is capable of processing signals at a first frequency, a second frequency and a third frequency;

wherein the antenna system supports:

a common electromagnetic mode, at the first frequency, in which at any given time electric field vectors between the elongated conductor and the finite ground surface on both sides of the point, point in substantially the same direction;

a differential electromagnetic mode, at the second frequency, in which at any given time, electric field vectors between the elongated conductor and the finite ground surface on a first side of the point are opposite in phase relative to electrical field vectors between the elongated conductor and the finite ground surface on a second side of the point; and a slot electromagnetic mode, at the third frequency, in which a substantial fraction of electromagnetic field energy is associated with an electric field including electric field lines that cross the slot.

13. The wireless communication device according to claim 12 wherein:

the elongated conductor comprises an inner edge, and an outer edge; wherein:

the outer edge is between about one-eighth and one-half times a first free space wavelength associated with the first frequency;

the inner edge is between about one-eighth and one times a second free space wavelength associated with the second frequency.

14. The wireless communication device according to claim 13 wherein:

the outer edge is between one-quarter and one-half the first free space wavelength;

the inner edge is between about one-quarter and one-half the second free space wavelength.

15. A wireless communication device comprising:

an antenna system comprising:

a finite ground surface;

an elongated conductor that is characterized by a length and is spaced from the finite ground surface, wherein the elongated conductor comprises:

a slot that extends through a substantial portion of the length of the elongated conductor;

a grounding conductor coupling the finite ground surface to the elongated conductor; and a signal feed conductor coupling to the elongated conductor;

a multi-layer circuit; wherein the finite ground surface includes one layer of the multi-layer circuit;

a housing enclosing the multi-layer circuit and the elongated conductor; and a plurality of components located adjacent the elongated conductor;

wherein at least a portion of the elongated conductor follows a convoluted contour to accommodate placement of one or more of the plurality of components.

16. A wireless communication device comprising:

an antenna system comprising:

a finite ground surface;

an elongated conductor that is characterized by a length and is spaced from the finite ground surface, wherein at least a substantial portion of the elongated conductor follows a substantially U shaped contour, wherein the elongated conductor comprises a slot that extends through a substantial portion of the length of the elongated conductor;

a grounding conductor coupling the finite ground surface to the elongated conductor; and a signal feed conductor coupling to the elongated conductor.

17. The wireless communication device according to claim 16 further comprising a multi-layer circuit; wherein the finite ground surface includes one layer of the multi-layer circuit; and one or more components are located on the multi-layer circuit within the U shaped contour of the elongated conductor.

18. A wireless communication device comprising:

an antenna system comprising:

a finite ground surface;

an elongated conductor that is characterized by a length and is spaced from the finite ground surface, wherein wherein the elongated conductor comprises:

a slot that extends through a substantial portion of the length of the elongated conductor; and a capacitive gap on one side of the slot;

a grounding conductor coupling the finite ground surface to the elongated conductor; and a signal feed conductor coupling to the elongated conductor.

19. A wireless communication device comprising:

an antenna system comprising:

a finite ground surface;

an elongated conductor that is characterized by a length and is spaced from the finite ground surface, wherein the elongated conductor comprises:

a slot that extends through a substantial portion of the length of the elongated conductor; and one or more shorts across the slot;

a grounding conductor coupling the finite ground surface to the elongated conductor; and a signal feed conductor coupling to the elongated conductor.

20. A wireless communication device comprising:

an antenna system comprising:

a finite ground surface;

an elongated conductor that is characterized by a length and is spaced from the finite ground surface, wherein the elongated conductor comprises:

a slot that extends through a substantial portion of the length of the elongated conductor;

a grounding conductor coupling the finite ground surface to the elongated conductor; and a signal feed conductor coupling to the elongated conductor; and a housing having a curved edge;

wherein the elongated conductor is supported on and conforms to the curved edge.

* * * * *

UNITED STATES PATENT AND TRADEMARK OFFICE

CERTIFICATE OF CORRECTION

PATENT NO. : 6,762,723 B2
DATED : July 13, 2004
INVENTOR(S) : Di Nallo, Carlo et al.

It is certified that error appears in the above-identified patent and that said Letters Patent is hereby corrected as shown below:

Column 17,
Line 62, delete “sound” and insert -- ground --.

Column 18,
Line 36, insert -- a -- before “grounding conductor”.

Signed and Sealed this

First Day of February, 2005

JON W. DUDAS
*Director of the United States Patent and Trademark Office*